US006141890A

United States Patent [19]

Chtn

[11] Patent Number: 6,141,890

[45] Date of Patent: Nov. 7, 2000

[54] SOLE PAD UNIT WITH THE EFFECTS SUPPORTING THE METATARSAL BONE AND AIRING AND MASSAGING THE CENTER OF THE SOLE OF FOOT

[76] Inventor: Shou Chtn, No. 307, Hua-Tsung Rd., Hsueh-Chia Chen, Tainan Hsien, Taiwan

[21] Appl. No.: 09/349,501

[22] Filed: Jul. 9, 1999

[51] Int. Cl.[7] ..... A61F 5/14; A43B 7/14; A43B 7/06

[52] U.S. Cl. ..... 36/147; 36/141; 36/3 B; 36/43; 36/145

[58] Field of Search ..... 36/91, 43, 140, 36/141, 3 B, 147, 145

[56] References Cited

U.S. PATENT DOCUMENTS

| | | |
|---|---|---|
| 1,236,924 | 8/1917 | Golden . |
| 1,476,915 | 12/1923 | O'Donnell . |
| 1,730,466 | 10/1929 | Mallott . |
| 1,845,681 | 2/1932 | Read . |
| 2,765,545 | 10/1956 | Conrad, Sr. . |
| 2,884,719 | 5/1959 | Compton . |
| 5,129,395 | 7/1992 | Hoffman . |

FOREIGN PATENT DOCUMENTS

| | | |
|---|---|---|
| 647580 | 8/1938 | Germany . |

*Primary Examiner*—Ted Kavanaugh
*Attorney, Agent, or Firm*—Dougherty & Troxell

[57] ABSTRACT

The subject invention is aimed at providing a sole pad unit with the effects of supporting the metatarsal bone and airing and massaging the center of the sole of foot, comprising mainly of a massage block, roughly in an "L" shape, located on the sole pad unit to correspond to the depressive part on the sole of foot, providing proper stimulation to the depressed part on the sole of foot, complying with ergonomic principles, at approximately the center of the massage block is a vent hole to produce airing effect and prevent bad smell, meanwhile there are slopes on the peripherals to prevent deformation of the massage block, the sole pad unit is applicable to slippers as well as all types of shoes, to achieve the effects of universal application and best comfort, and to achieve the purpose of better health with the massage block to support the metatarsal bone and massage the reflective area of acupoints on the depressed part of the sole of foot.

1 Claim, 7 Drawing Sheets

SOLE PAD UNIT WITH THE EFFECTS SUPPORTING THE METATARSAL BONE AND AIRING AND MASSAGING THE CENTER OF THE SOLE OF FOOT

BACKGROUND OF THE INVENTION

Since 1977 when Father Wu Ruo demonstrated his therapy on arthritis by massage on the sole of foot, the practice has received worldwide attention and become a fad in this country. High demand on this practice has prompted the introduction of various massage appliances and gadgets on the market, which therapeutic effects have been affirmed by the general public. As shown in FIG. 1, which illustrates a type of massage slipper and sole pad easily available on the market, on a sole pad unit 1 are all massaging balls 10, which produce massaging effect when they are in contact with the sole of foot, but its massaging efficiency is quite limited, because the depressed part on the sole of foot will be unable to have any contact with the massaging balls 10, so that is a blind corner. An important fact is that there are many acupoint reflective areas in the depressed part of the sole, which are essential to human health, including, as shown in FIG. 2, heart A, spleen B, prostate gland (uterus) C, uric bladder D, ureter E, kidney F, pancreas G, adrenal gland H, solar nerve cluster I, gall bladder J, liver K, penis (vagina) L, etc., as a result, it could not achieve the effects during its application; there is another model of massage slippers, as shown in FIG. 3, which involves several pebble-shaped toe bridges 20 on a sole plate 2 to correspond to the positions of toes, and on the locations corresponding to the depressed part of the sole of foot are pebble-shaped protrusion 21 and burg-shaped protrusion 22, such slippers will improve the shortcoming of aforementioned prior art of slippers, but its improvement is merely partial, since although there is the pebble-shaped protrusion 21 on the depressed part of the sole, it involves also the burg-shaped protrusion 22 on the heel location, which is inconsistent with ergonomic principle, as indicated by the distribution of body weight on human feet, the weight is supported by the foot palm and the heel, since the pebble-shaped protrusion 21 and the depressed part of the sole are only in slight contact, it has limited effects on the various reflective areas on the depressed part of the sole of foot, and since the height of the burg-shaped protrusion 22 on the heel position is too high, it results in insufficient contact between the pebble-shaped protrusion 21 and the depressed part of the sole, therefore, it could not have real effects; the Japanese have come up with a type of health slippers to enable effective massage on the acupoint reflective areas or, the depressed part of the sole, which, popularly known as "Japanese slippers", is shown in FIG. 4. Said slippers have a length of about ⅔ of that of the foot, the massage effect can be achieved since the depressed part of the sole is justly located at the end of the slipper, since the user's heel is not in contact with the floor when he is wearing such a type of slippers, the depressed part of the sole can be massaged by the end part of the slipper, but it has been indicated by medical researchers that said slippers will result in deformation on the feet after they are worn for an extended period of time since the heels are not in contact with the floor, which is bad to human health, and said slippers are not suitable for outdoor use which would be considered vulgar by the society, therefore, they need improvement.

In view of the aforementioned drawbacks of conventional models of slippers, the subject inventor has utilized several years experience in the production of shoe-sole pads, accompanied by the research in sole massage reflective areas, and has come up with the subject invention.

SUMMARY OF THE INVENTION

The subject invention relates to a sole pad unit with the effects of supporting the metatarsal bone and massaging the center of the sole of -foot, particularly to a type equipped with a massage block on a sole pad unit, to enable the effects of supporting the metatarsal bone and massage the sole, there being a vent hole on the massage block to prevent bad smell, and on the peripheral of the roughly "L"-shaped massage block are slopes to comply with ergonomic requirements and prevent deformation, which will be applicable to slippers as well as various types of shoes, to achieve the purposes of best comfort and health.

DETAILED DESCRIPTION OF THE INVENTION

The main objective of the invention is to provide a sole pad with functions to support the metatarsal bone and massage the reflective areas of acupoints, with ventilation and ergonomic considerations.

To achieve the aforementioned objective and functions, a preferred embodiment is described below with reference made to the diagrams.

Figure 1:
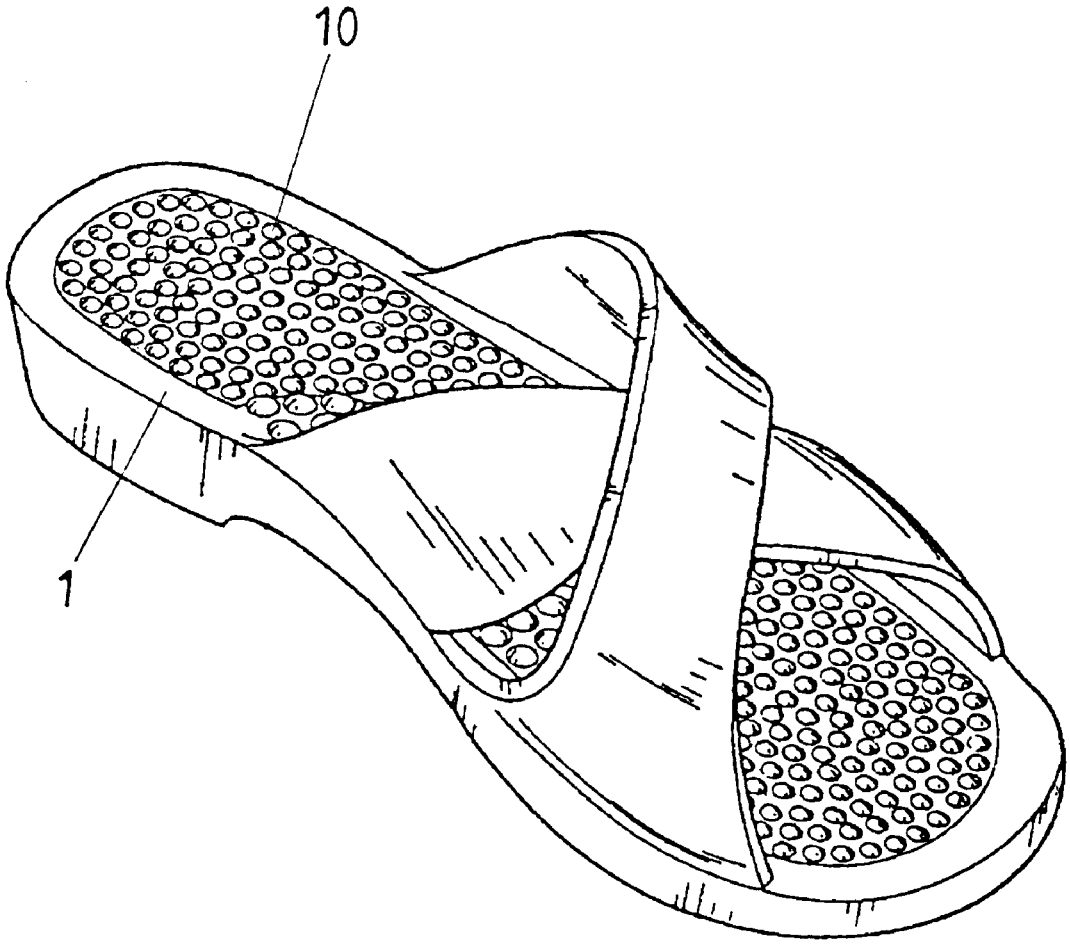
FIG. 1 PRIOR ART
FIG. 1 Is a perspective view of a prior art of massage slipper.
Figure 2:
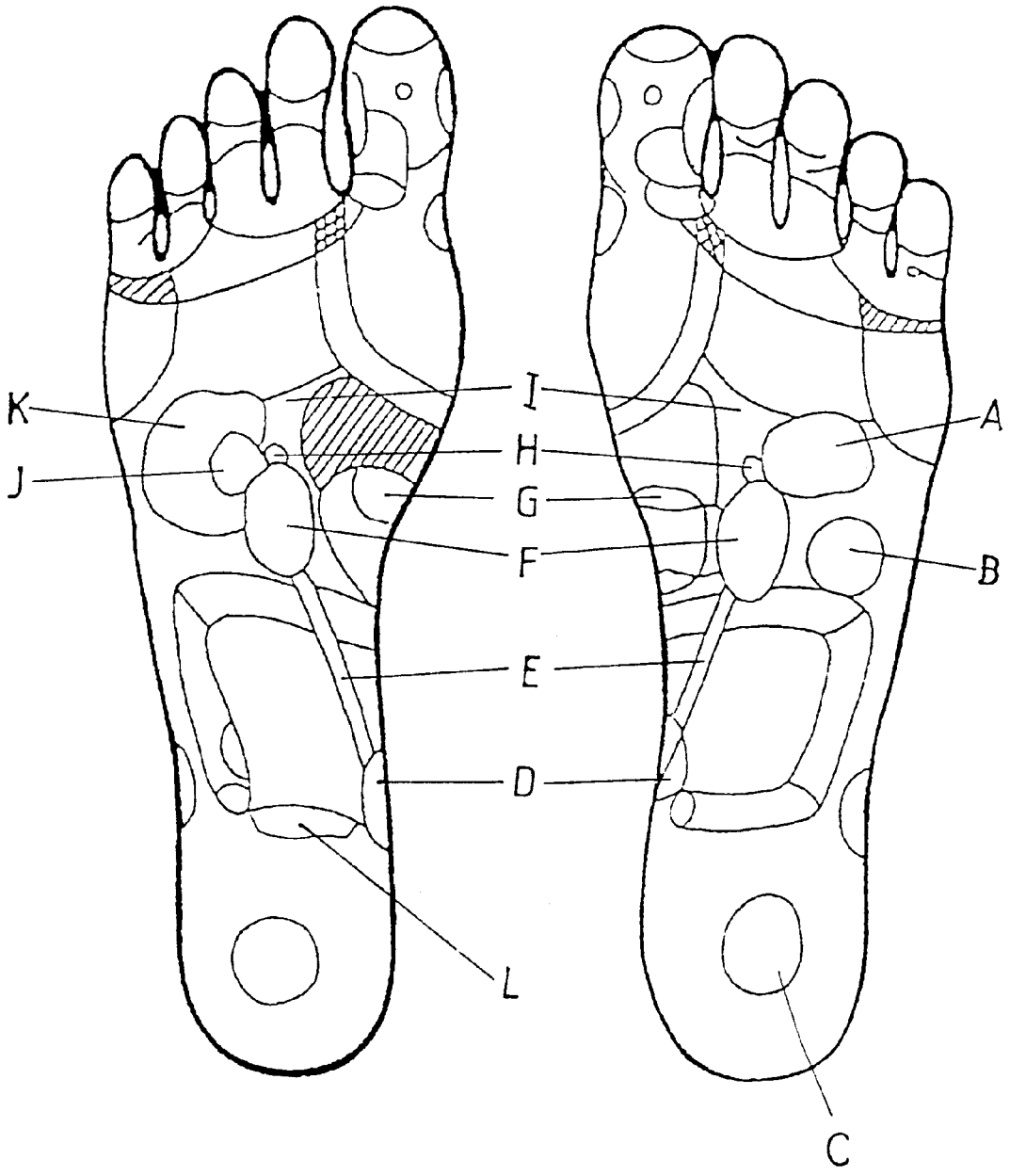
FIG. 2 PRIOR ART
FIG. 2 is view of the reflective areas of acupoints in sole massage.
Figure 3:
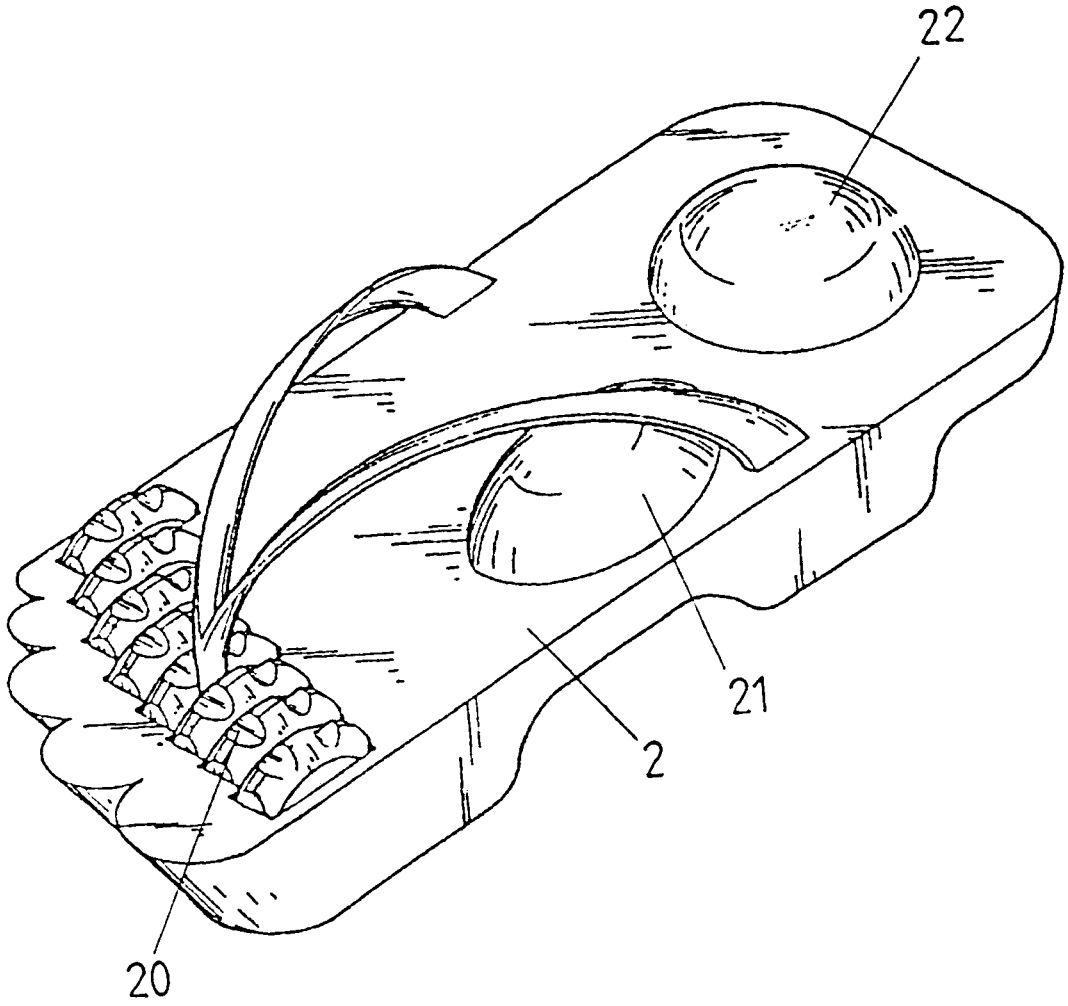
FIG. 3 PRIOR ART
FIG. 3 is a perspective view of another prior art of massage slipper.
Figure 4:
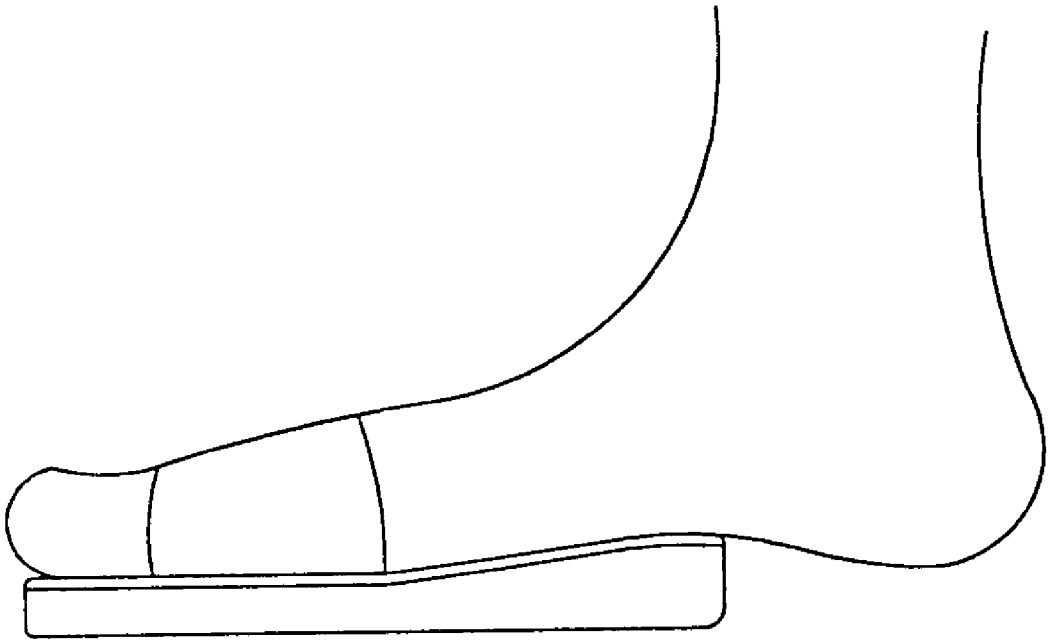
FIG. 4 PRIOR ART
FIG. 4 is a view of a prior art of Japanese slipper.
Figure 5:
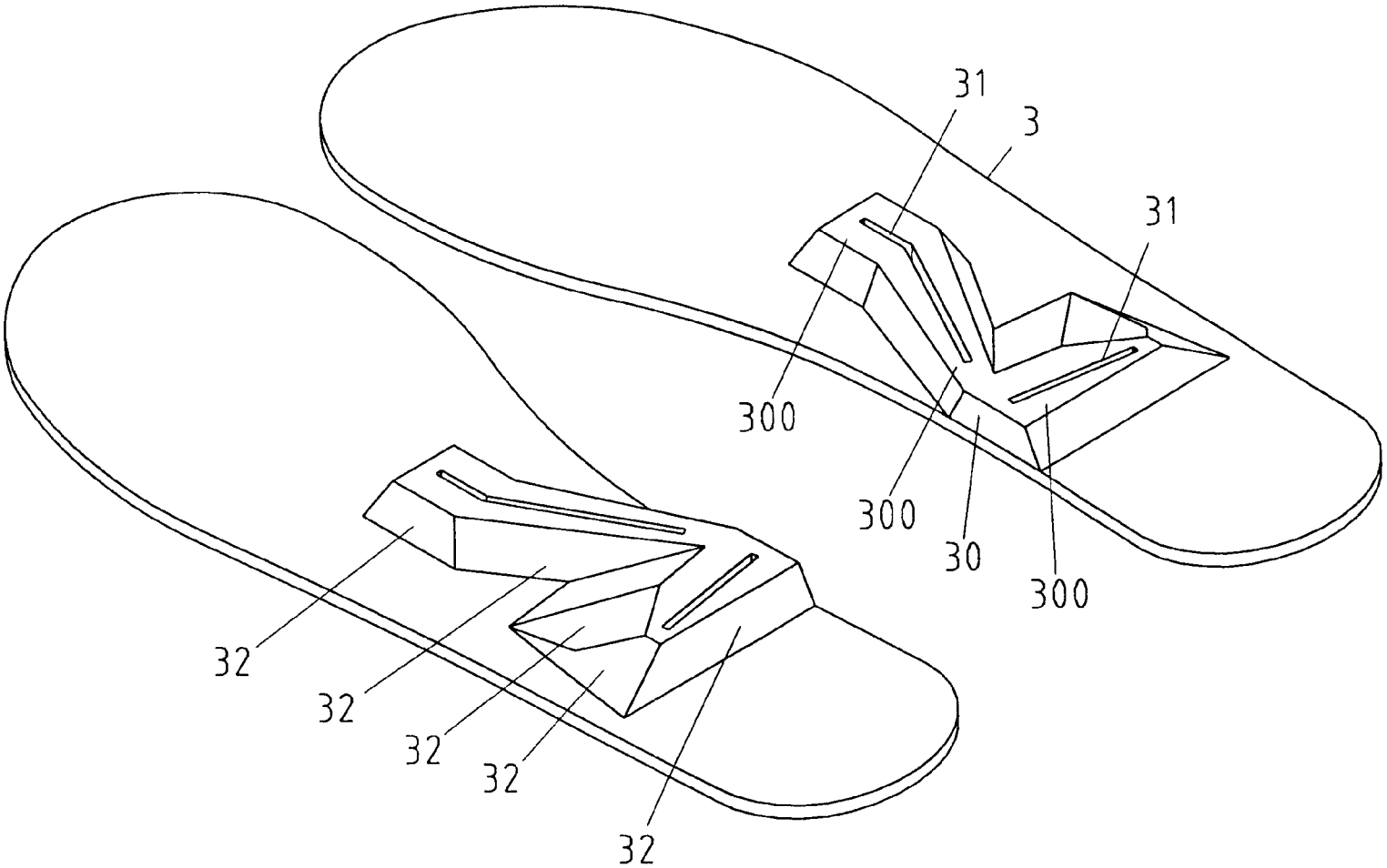
FIG. 5 is a perspective view of the invention.
Figure 6:
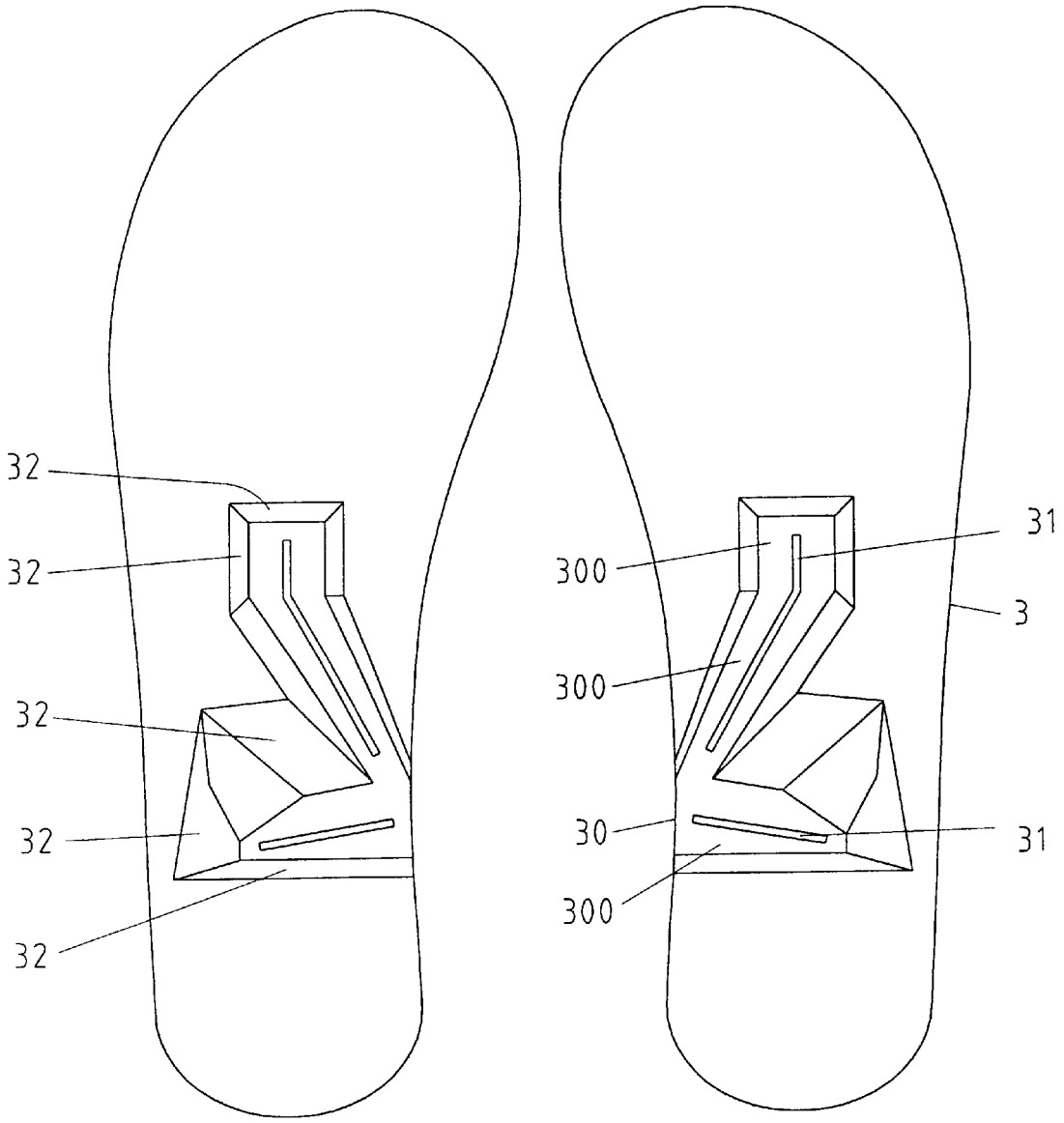
FIG. 6 is a plain view of the invention.

Please refer to FIG. 5, which is a perspective view of the subject invention that involves mainly a massage block 30 that is fitted to a location on a sole pad unit 3 to correspond to the depressed part of the sole, said massage block 30 being comprised of one or more protruded units 300 with various geometrical shapes and forms, each shaped somewhat as an "L" and made of flexible high-polymer materials, near the center of said massage block 30 is a penetrated vent hole 31, on the peripheral of said massage block are gradually inclined and outwardly-extended slopes 32 (as shown in FIG. 6), the shape of said massage block 30 being designed to suit that of the depressed part of the sole of foot, and its height is about 1.5 centimeters which is designed to reach a suitable depth to the depressed part of the sole, therefore, with such ergonomic consideration, there will be best comfort provided to the user who will not feel any pain.

Figure 7:
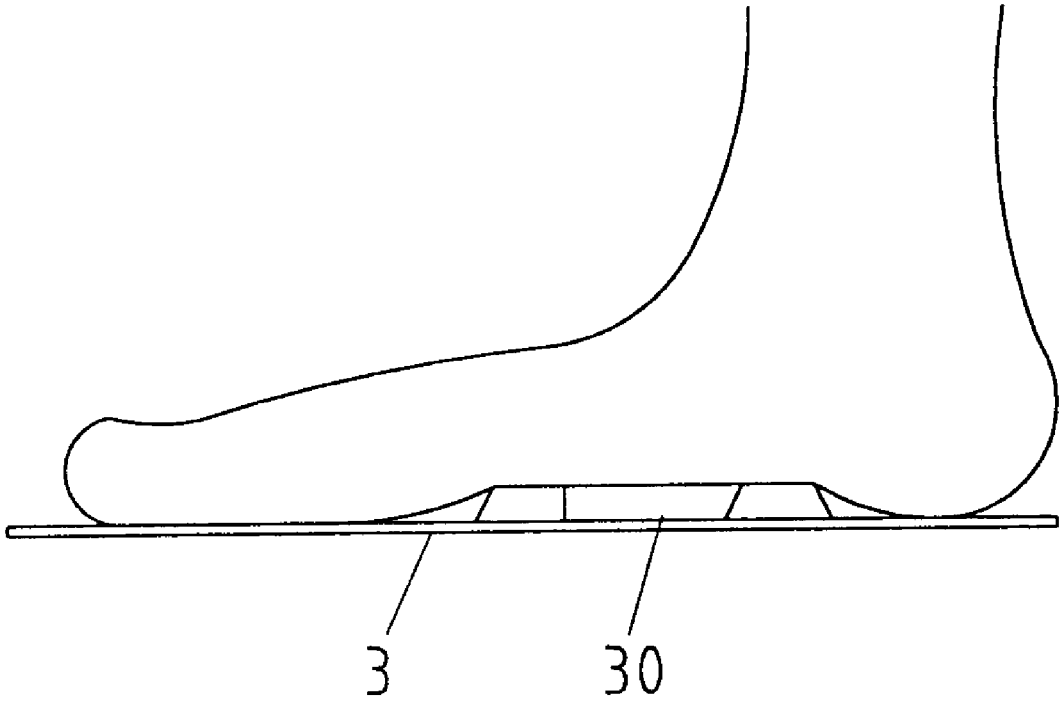
FIG. 7 is a view of the subject invention being worn by the user.

When it is worn on a user's foot, as shown in FIG. 7, since the depressed part of sole is justly on top of the massage block 30, so it will support the metatarsal bone, and its shape and height are suitably designed to enable the effect of massage on the reflective area of acupoints on the sole, and with the ventilating effect of the vent hole 31 the foot will feel comfortable without dampness, thus it will prevent any bad smell, meanwhile, the effect of the slope 32 will prevent deformation of the massage block 30 when it is subjected to pressure, therefore it will achieve best massage performance and will last long.

When the user wears the subject invention of sole pad, it will act on the reflective area and massage the acupoints on the sole of foot, particularly it will have therapeutic effects on all important acupoints in the depressed area on the sole, and, after it is worn for an extended period of time, it will improve the user's physical conditions, stimulate blood circulation, help metabolism, especially to the health of senior people, such discomforts as arthritis, rheumatism, gout, hypertension, heart disorder, uric acid, diabetes, stroke, polio, epilepsy, prostatitis, Alzheimer's disease, etc. can be improved significantly, furthermore, it may be of help to the prevention of cold, enhancement of sexual potency, etc. The subject invention of sole pad unit can be directly fitted directly onto slippers or inside all types of shoes, therefore, it is universal in application, beautiful in appearance and comfortable to wear.

Features of the subject invention can be listed below:

1. Said massage block will support the metatarsal bone, its shape and height being designed to suit the depressed part on the sole of foot, thus it complies with the principles of ergonomics and is comfortable to wear.
2. Massage on the reflective area of acupoints in the depressed part of the sole will bring about protective effect to all important organs of human body, and will achieve the objective of better health.
3. By means of the vent hole to allow air to pass through the unit, thus bad smell can be avoided.
4. The slopes on the peripherals of the massage block will prevent deformation, achieve excellent massage effects, its solid construction will last long.
5. The subject invention of sole pad unit can be directly be spread on the sole of a slipper or all sorts of shoes, therefore, it can achieve the effects of universality in application and beautiful in appearance.

Summing up, with sufficient evidence to achieve the aforementioned objectives and functions, and with its applicability and inventive step to surpass conventional products, and without similar constructions or features being publicized or used in public before the subject application, the subject invention has satisfied the requirements for application for a patent right, therefore, this application is duly filed. Your favorable consideration shall be appreciated.

What is claimed is:

1. A sole pad unit for supporting the metatarsal bone and airing and massaging the center of the sole of a foot comprising a sole pad having an outer edge, a heel portion, a forward portion and a middle portion between said heel and forward portions, an elevated member made of flexible high-polymer material having a height of approximately 1.5 cms, said elevated member including a rear portion adjacent to said edge of said sole pad and extending substantially across said heel portion of said sole pad, said rear portion of said elevated member including a longitudinally extending vent, said elevated member also including a first forwardly extending portion which forms an acute angle with said rear portion and a second forwardly extending portion which forms an oblique angle with said first forwardly extending portion and wherein each of said portions of said elevated member include a plurality of sloping edges which slope downwardly and outwardly in the direction of the outer edge of said sole pad and in which each of said forwardly extending portions include a longitudinally extending vent.

* * * * *